US007025214B2

(12) United States Patent
Klein et al.

(10) Patent No.: US 7,025,214 B2
(45) Date of Patent: Apr. 11, 2006

(54) OVER-DOOR SHOE RACKS

(75) Inventors: Richard B. Klein, Overland Park, KS (US); Chris Serslev, Leawood, KS (US); John W. Scott, Lenexa, KS (US)

(73) Assignee: Lynk, Inc., Lenexa, KS (US)

( * ) Notice: Subject to any disclaimer, the term of this patent is extended or adjusted under 35 U.S.C. 154(b) by 0 days.

(21) Appl. No.: 10/657,341

(22) Filed: Sep. 8, 2003

(65) Prior Publication Data

US 2004/0159619 A1 Aug. 19, 2004

Related U.S. Application Data

(62) Division of application No. 10/189,638, filed on Jul. 3, 2002, now Pat. No. 6,637,603, which is a division of application No. 09/641,323, filed on Aug. 18, 2000, now Pat. No. 6,533,127.

(60) Provisional application No. 60/149,794, filed on Aug. 19, 1999.

(51) Int. Cl.
*A47F 7/08* (2006.01)

(52) U.S. Cl. ..... 211/35; 211/113; 211/87.01

(58) Field of Classification Search ..... 211/34–36, 211/113, 118, 193, 194, 87.01, 90.01, 105.1, 211/105.2, 119.004; D6/513, 514, 566–567, D6/569–570, 315, 317, 320, 553; 248/301, 248/364, 214, 215, 300
See application file for complete search history.

(56) References Cited

U.S. PATENT DOCUMENTS 953,130 A 3/1910 Fellows
1,238,275 A 8/1917 Deeley
1,310,281 A 7/1919 Clark
1,377,444 A 5/1921 Shoemaker
1,401,356 A 12/1921 Parchert
1,450,948 A 4/1923 Glidden
1,567,038 A 12/1925 Cavanna
1,570,451 A 1/1926 Simoneau
1,632,820 A 6/1927 Cofar
1,646,137 A 10/1927 Campbell
1,674,359 A 6/1928 Frey
1,703,190 A 2/1929 Glidden
1,712,984 A 5/1929 Dustan
1,724,386 A 8/1929 Weston
1,733,487 A 10/1929 Hackley
1,769,344 A 7/1930 Hoffmire
1,821,771 A 9/1931 Roberts
D85,502 S 11/1931 Wilhelm
1,886,961 A 11/1932 Knape
1,962,970 A 6/1934 Ple et al.
1,984,827 A * 12/1934 Derman ..... 312/4

(Continued)

FOREIGN PATENT DOCUMENTS

FR 1 462 095 11/1966 ..... 211/37

*Primary Examiner*—Jennifer E. Novosad
(74) *Attorney, Agent, or Firm*—Blackwell Sanders Peper Martin LLP; Richard R. Johnson

(57) ABSTRACT

A shoe rack for mounting to an upright surface, or for hanging over a door, includes a pair of plastic, vertical side frame members and a plurality of shoe-retaining bars positioned between the side frame members upon which shoes, boxes and the like may be supported. A number of different embodiments are shown, each of which incorporates different features, including the feature of a loop projecting upwardly from each arm to provide a side barrier for retaining shoes on the rack. The loop has a configuration to provide an open space above the arm.

1 Claim, 15 Drawing Sheets

U.S. PATENT DOCUMENTS 1,995,383 A 3/1935 Fischer
2,090,108 A * 8/1937 Cicero ..... 211/35
2,157,001 A 5/1939 Morley
2,195,919 A 4/1940 Crilly et al.
D121,112 S 6/1940 Deja
2,205,817 A 6/1940 Kramb
2,238,884 A 4/1941 Hoffman
2,276,141 A * 3/1942 Atkinson ..... 211/37
2,295,886 A 9/1942 Beck
2,299,021 A 10/1942 Hoffman
D139,415 S * 11/1944 Brown ..... D6/320
2,409,268 A 10/1946 Gerlich
2,412,847 A * 12/1946 Van Tilburg ..... 211/35
2,415,518 A 2/1947 Niesner
2,459,909 A 1/1949 Alofs
2,504,910 A 4/1950 Wellington
2,565,593 A 8/1951 Clausing
D165,942 S 2/1952 Stein
2,605,905 A 8/1952 Willmott
2,620,929 A 12/1952 Sportsman
2,654,487 A 10/1953 Degener
2,682,955 A 7/1954 Moore
2,701,564 A 2/1955 Wilhelm
2,815,862 A 12/1957 Einhorn
2,845,182 A 7/1958 Atkinson
2,901,117 A 8/1959 Plocki et al.
3,002,629 A 10/1961 Gersin et al.
3,061,108 A * 10/1962 Duggan ..... 211/37
3,171,542 A 3/1965 Jacobs et al.
3,391,793 A 7/1968 Streuli
3,468,426 A 9/1969 Loewy
3,578,282 A 5/1971 Olsen
3,637,084 A 1/1972 Uitz
3,775,794 A 12/1973 Fisher
3,792,804 A 2/1974 Ponzo
3,913,745 A 10/1975 Weiss
3,918,670 A 11/1975 Doherty
3,974,917 A 8/1976 Waxmanski
3,999,734 A 12/1976 Gibson et al.
4,094,030 A 6/1978 Saad
4,162,730 A * 7/1979 Steere et al. ..... 211/118
4,199,070 A 4/1980 Magnussen, Jr.
4,200,993 A 5/1980 Blanc et al.
4,209,098 A 6/1980 Adams
4,245,746 A 1/1981 Aylor
4,343,172 A 8/1982 Nordlund
4,403,703 A * 9/1983 Nikles, Jr. ..... 211/193
4,457,436 A 7/1984 Kelley
4,463,853 A 8/1984 Licari et al.
D283,570 S 4/1986 Penner
D285,266 S 8/1986 Bowsher
4,607,753 A 8/1986 Radek
D287,550 S 1/1987 Tocci
4,657,148 A 4/1987 Heng
4,678,151 A 7/1987 Radek
4,688,681 A 8/1987 Bergeron
4,688,687 A 8/1987 Pryor
4,693,380 A 9/1987 Muth
4,711,419 A 12/1987 Polosky
D295,129 S 4/1988 Chap
4,754,885 A 7/1988 Rich
4,805,783 A 2/1989 Mayer
4,825,601 A 5/1989 Halverson
4,899,971 A 2/1990 Elkin
4,915,238 A 4/1990 Cassel
4,936,467 A 6/1990 Bobeczko
4,942,498 A 7/1990 Toussaint
4,981,221 A 1/1991 Davis
5,035,332 A 7/1991 Stravitz
5,048,698 A 9/1991 Konrad
5,054,629 A 10/1991 Breen
5,078,270 A 1/1992 Campbell
5,082,125 A 1/1992 Ninni
D324,787 S 3/1992 Evans
5,097,968 A 3/1992 Gregory
5,101,986 A 4/1992 Holztrager
5,101,989 A 4/1992 Jones
5,103,985 A 4/1992 Davis
5,152,407 A 10/1992 Massoudnia et al.
5,172,816 A 12/1992 Kline et al.
D354,412 S 1/1995 Emery
5,566,838 A 10/1996 Tseng
D377,728 S 2/1997 Klein et al.
5,617,959 A * 4/1997 Klein et al. ..... 211/37
5,641,079 A 6/1997 Schmidt
D381,225 S 7/1997 Malik
D382,434 S 8/1997 Klein et al.
5,695,073 A 12/1997 Klein et al.
5,785,185 A 7/1998 Klebba
D398,787 S 9/1998 Malik
D403,187 S 12/1998 Klein et al.
D403,880 S 1/1999 Malik
5,855,279 A 1/1999 Klein et al.
D419,349 S 1/2000 Klein et al.
6,050,532 A 4/2000 Paul
6,138,841 A * 10/2000 Klein et al. ..... 211/85.7
6,464,086 B1 10/2002 Klein et al.
6,533,127 B1 3/2003 Klein et al.

* cited by examiner

OVER-DOOR SHOE RACKS

CROSS-REFERENCE TO RELATED APPLICATIONS

The present application is a division and claims priority from U.S. application Ser. No. 10/189,638, filed Jul. 3, 2002, now U.S. Pat. No. 6,637,603 entitled "Over-Door Shoe Racks", which is a divisional of U.S. application Ser. No. 09/641,323, filed Aug. 18, 2000 and now U.S. Pat. No. 6,533,127, issued Mar. 18, 2003, entitled "Over-Door Shoe Racks" and which claims priority from U.S. Provisional Application Ser. No. 60/149,794, filed Aug. 19, 1999, entitled "Over-Door Shoe Racks".

STATEMENT REGARDING FEDERALLY SPONSORED RESEARCH OR DEVELOPMENT

Not Applicable.

BACKGROUND OF THE INVENTION

The present invention is generally directed to a hanging shoe rack, and is more particularly directed to a number of embodiments for shoe racks that hang from, or are positioned on, the back of the door or on another upright surface.

Hanging shoe racks are well known. For example, U.S. Pat. No. 5,695,073, entitled "Hanging Shoe Rack", is directed to a hanging shoe rack having a pair of plastic side frame members, and a plurality of support bars positioned between the side frame members on which shoes may be supported. The present invention is directed to such a product, albeit with different features. U.S. Pat. No. 5,695,073 is incorporated by reference, in its entirety, herein.

In particular, the shoe rack set forth in U.S. Pat. No. 5,695,073 includes first and second plastic side frame members. Each side frame member has as vertical member having a plurality of support arms extending outwardly and downwardly therefrom. The product has a plurality of shoe retaining bars. The shoe retaining bars are oriented in pairs, with each pair of bars aligned in a plane forming an acute angle with respect to the vertical surface on which the shoe rack is positioned. In this regard, one bar of each pair is positioned at outward ends of respective arms, while the other shoe retaining bar of the pair is positioned between the vertical members of the respective side frame members.

As illustrated best in FIG. 2 of U.S. Pat. No. 5,695,073, the vertical members of the plastic side frame members are preferably spatially removed from the upright surface or door, due to the presence of leg members at upper and lower portions of the side frame members. Hangers, or brackets, are positioned over the door and receive foot members extending downwardly from leg members, as clearly illustrated and described in the '073 patent. As illustrated and described, when the hanging shoe rack product is positioned on an upright surface, the vertical members and outwardly and downwardly depending arms serve as lateral barriers to retain the shoes on the shoe rack.

SUMMARY OF THE INVENTION

Each embodiment of the present invention is directed to a shoe rack for mounting to an upright surface, or for hanging over a door. Each embodiment of the present invention employs two plastic side frame members, and a plurality of shoe retaining bars positioned between the side frame members, upon which shoes, boxes, and the like may be supported. However, each embodiment of the present invention incorporates different features, resulting in improved structure integrity over the prior art and/or resulting in a product that is less expensive to manufacture and/or resulting in a product which retains shoes on the shoe rack in a different, or better, manner.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

With reference now to the figures, it is again noted that each embodiment of the present invention employs first and second side frame members, preferably made of plastic, and a plurality of shoe retaining bars oriented in pairs. Additionally, each embodiment of the present invention preferably employs components or means for mounting the shoe rack to an upright surface or for hanging the shoe rack over a door. Additionally, each embodiment of the present invention preferably is a modular shoe rack, in that one shoe rack may be connected to another shoe rack of the invention, in a manner such as that set forth in U.S. Pat. No. 5,695,073. The following described drawings illustrate only one side frame member, or a portion thereof, since the remainder of the product will be readily understood in view of that which is disclosed herein, and that which has been incorporated herein by reference.

Figure 1:
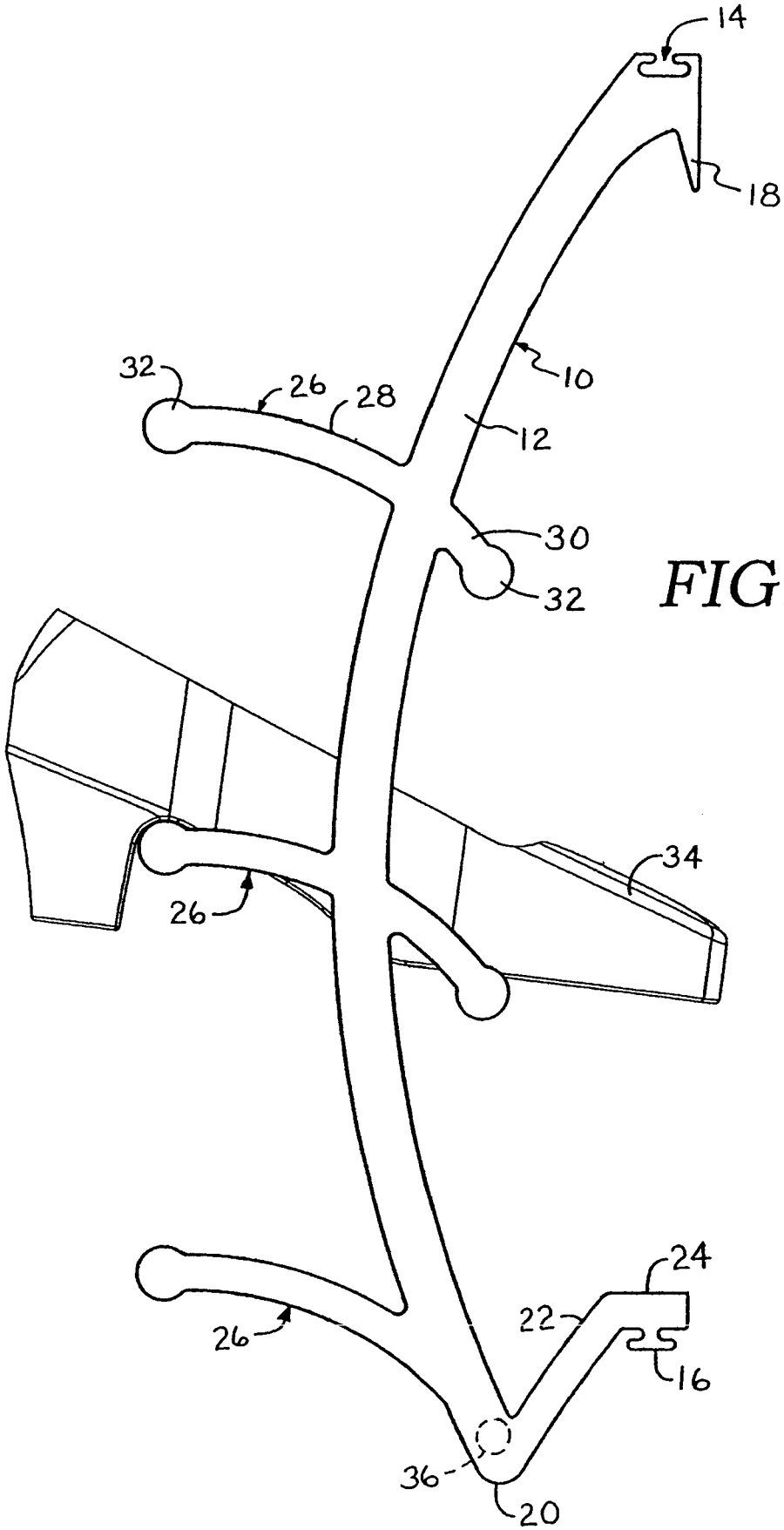
FIG. 1 illustrates a first embodiment of the shoe rack of the present invention.

With reference initially to FIG. 1, a hanging shoe rack of the present invention has first and second plastic side frame members, with one such side frame member (a right side member) being illustrated and denoted generally by reference numeral 10. Side frame member 10 is preferably integrally formed of molded plastic. Side frame member 10 has a primary, arcuate, or curved member, often times referred to as a main body section, denoted generally by the reference numeral 12. Preferably, curved member 12 has an upper end, including a female socket 14, and a lower end, including a male member 16. As will be appreciated, one shoe rack of this embodiment of the invention can be connected to another shoe rack of this embodiment of the invention by placing the male member 16 of a first side frame member 12 in the female member 14 of a second side frame member 10, such that one shoe rack depends from the other. Additionally, side frame member 10 preferably has a foot member 18, which is received by a hanger such as the hanger illustrated and described in U.S. Pat. No. 5,695,073, incorporated herein by reference.

Curved side frame member 12 preferably curves downwardly from an upper portion thereof to a lower most portion, denoted by the reference numeral 20. As illustrated, the lower most portion 20 of the side frame member is positioned outwardly from a rear portion of the side frame member 10, such that the curved member 12 does not curve all the way back to the vertical surface. Instead, an intermediary portion 22, which is preferably angled backwardly and upwardly, is positioned between the lower most portion 20 of side frame member 10 and a horizontal, rear member 24, from which the male member 16 depends.

A plurality of curved support arms, denoted by reference numeral 26, are positioned on plastic side frame member 10 and, in fact, are integrally formed therewith. The upper tiers of support arms 26, illustrated by the uppermost two tiers of FIG. 1, have a first portion 28 which extends outwardly in a first direction from the curved portion 12 and a second portion 30 which extends outwardly in an opposite direction from the curved side frame portion 12. Each arm 26 terminates in an enlarged outer end, denoted by reference numerals 32, which have sockets therein (on a reverse side from that shown), for receiving shoe retaining bars in a conventional manner. As illustrated, a shoe 34, when positioned on the shoe retaining bars, is retained from lateral movement both by the curvature of the support arm 26, as well as by the curved side portion 12. It is noted that, in the lowermost tier of shoe retaining bars, one of the sockets, denoted by reference numeral 36, is positioned in the member 12, as illustrated. The shoe rack illustrated in FIG. 1 is particularly useful for preventing shoes from falling off of the shoe rack, particularly when the shoe rack is positioned on a door, such that when the door is swung from an open to closed or closed to open position, the support arms 26 and curved member 12 prevent lateral movement of the shoes. Additionally, the curved nature of member 12 distributes stress on the shoe rack, resulting from the weight of the shoes positioned on the shoe rack, in an even or substantially even manner, thus reducing the stress points that would typically be found at an upper end of the rack.

Figure 2:
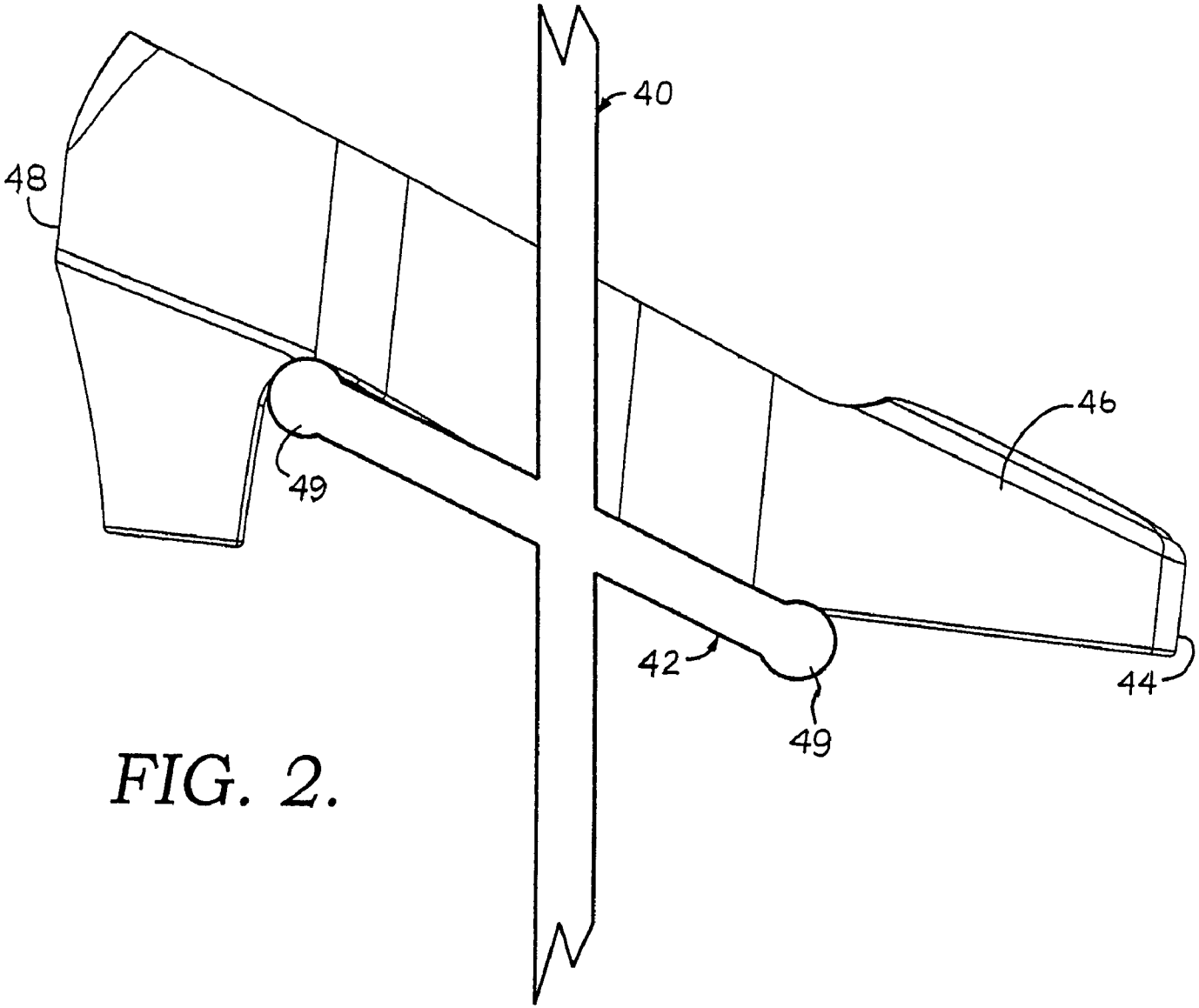
FIG. 2 is a fragmentary view illustrating a second embodiment of a hanging shoe rack of the present invention.

With reference now to FIG. 2, an alternate embodiment is illustrated and described. Particularly, in the embodiment of FIG. 2, a vertical side frame member 40 is provided, with a plurality of linear support arms 42. Each support arm has a portion thereof extending upwardly and outwardly from a first side of the vertical member 40, and another portion thereof extending downwardly and outwardly from an opposite side of the vertical member 40. In particular, the shoe rack is preferably positioned such that the toe 44 of the shoe 46 abuts up against the vertical surface upon which the shoe rack is mounted. Alternatively, however, the shoe rack could be constructed such that the vertical surface is positioned proximate the heel portion 48 of the shoe. The vertical member 40, as well as the enlarged outer portions 49 of support arm 42, prevent lateral movement of the shoe. As will be understood and appreciate, enlarged outer portions 49 have sockets (on an opposite side of that shown) for receiving shoe retaining bars.

Figure 3:
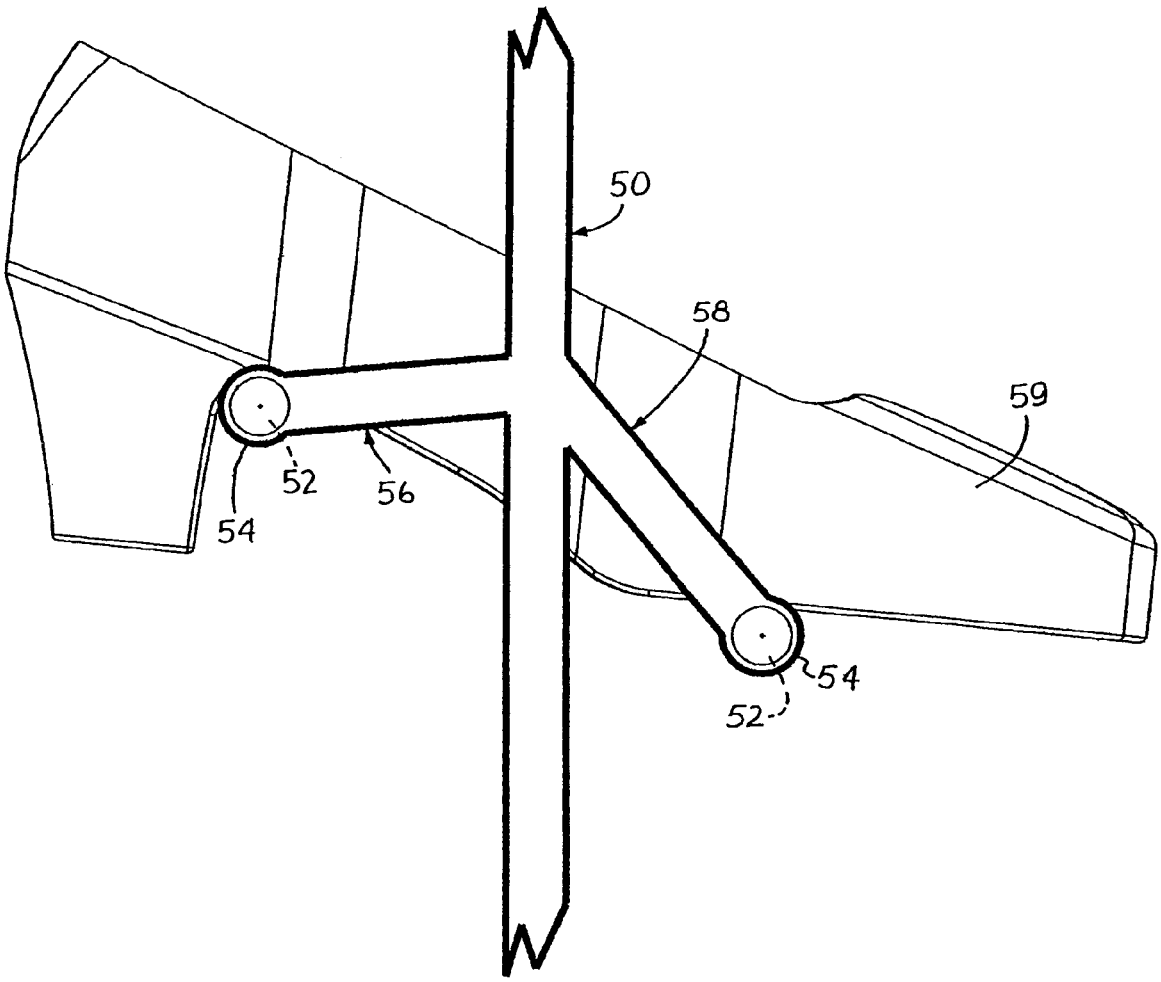
FIG. 3 is a fragmentary view illustrating a third embodiment of a hanging shoe rack of the present invention.

In the embodiment of FIG. 3, the shoe rack again has a vertical side frame member 50, and shoe retaining bars oriented in pairs and positioned in respective sockets 52 in enlarged outer ends 54 of corresponding support arms 56, 58. As illustrated, support arm 56 preferably angles outwardly and downwardly in a first direction from vertical member 50, while support arm 58 depends outwardly and downwardly in a second direction from vertical member 50. Thus, the arms meet at somewhat of a peak at vertical member 50. As illustrated, the combination of vertical member 50 and arms 56, 58 create a barrier against lateral movement of the shoe 59.

Figure 4:
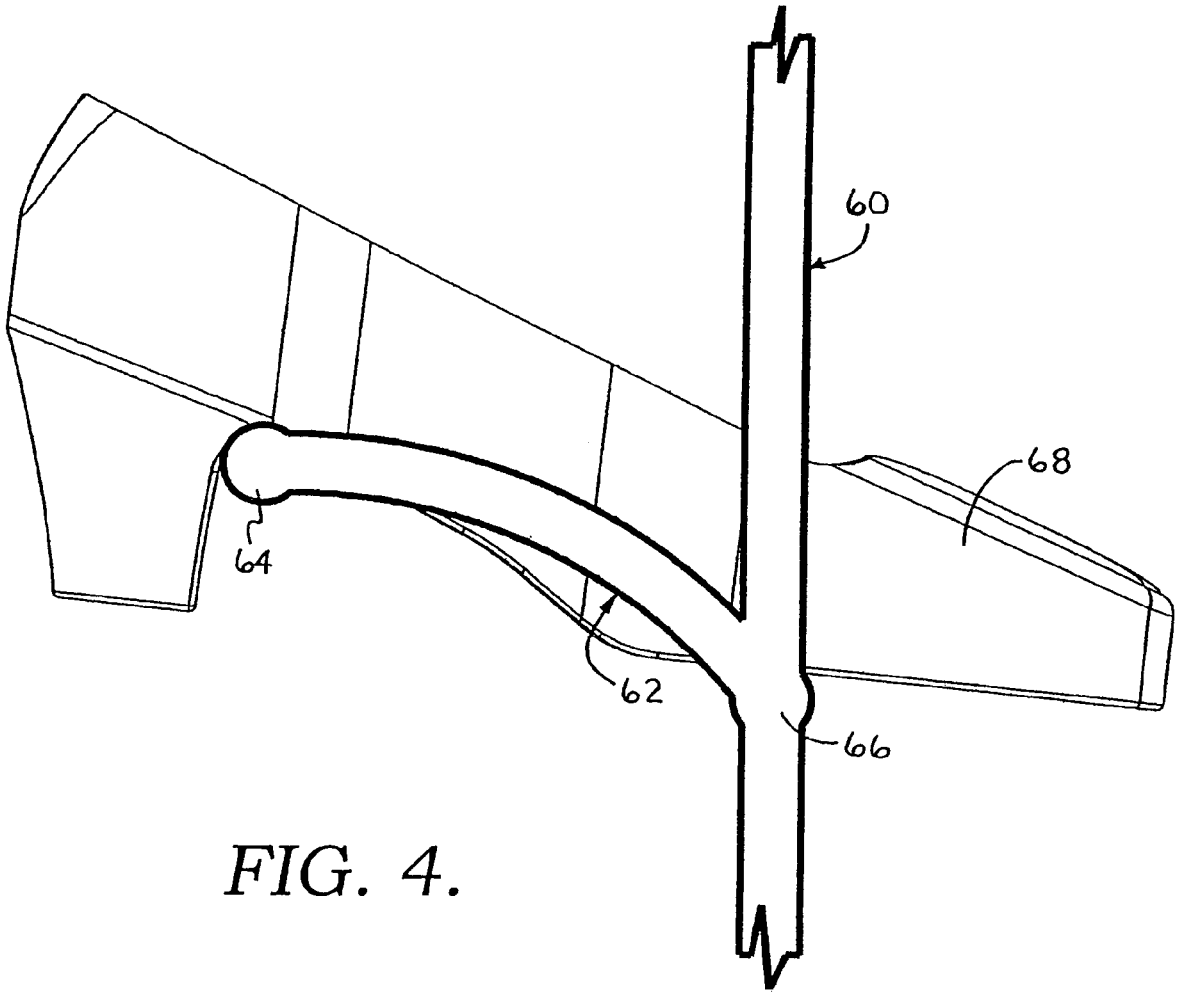
FIG. 4 is a fragmentary view illustrating a fourth embodiment of a hanging shoe rack of the present invention.

With reference now to FIG. 4, the hanging shoe rack of the present invention includes a vertical side frame member 60 and a plurality of outwardly extending, curved support arms 62. Sockets for receiving shoe retaining bars are positioned at locations 64 and 66. As illustrated, the combination of vertical member 60 and the curved arm 62 provide a barrier against lateral movement of the shoe 68.

Figure 5:
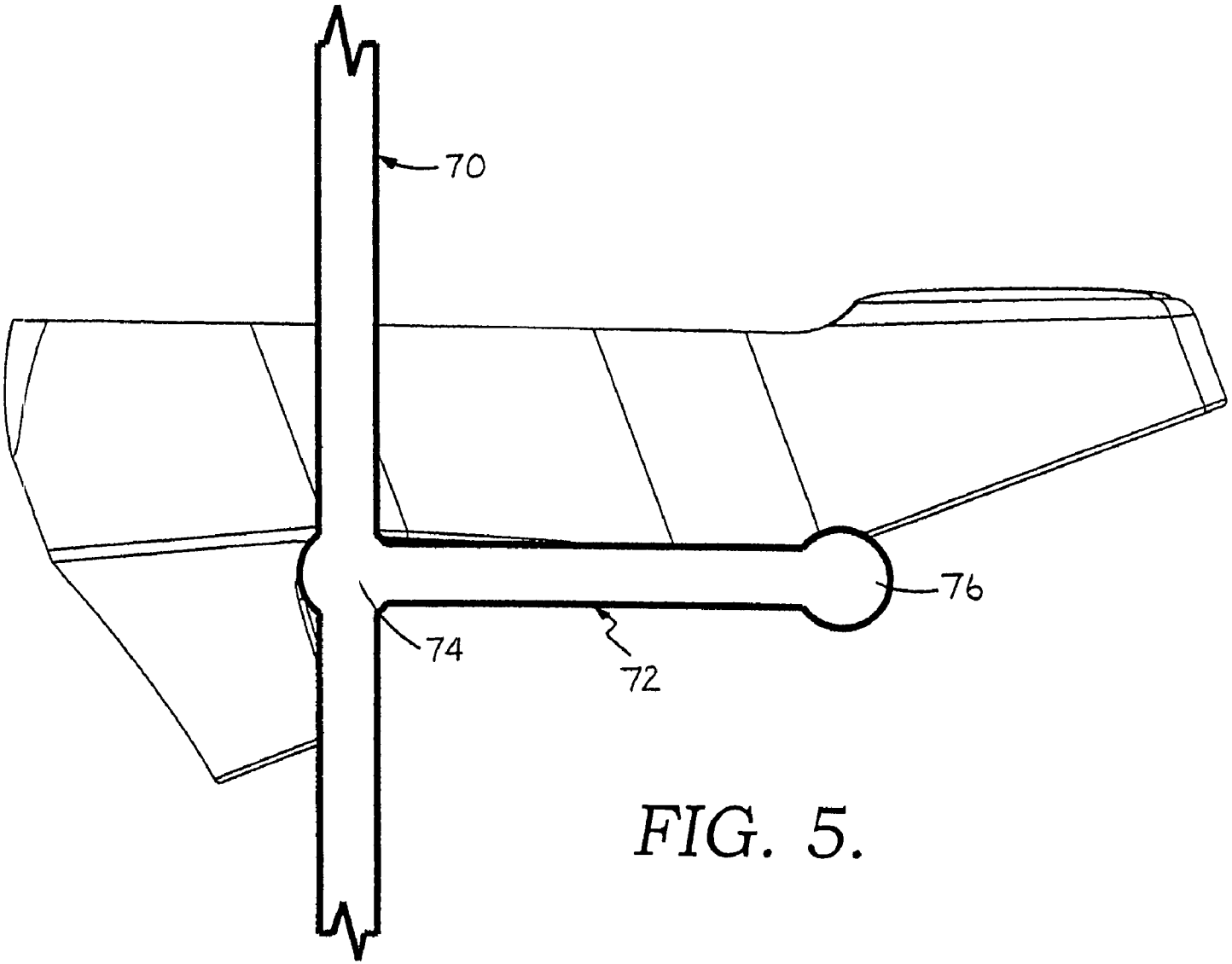
FIG. 5 is a fragmentary view illustrating a fifth embodiment of a hanging shoe rack of the present invention.

With reference now to FIG. 5, the hanging shoe rack includes a vertical member 70 and a plurality of horizontal, outwardly extending support arm 72. Sockets for receiving shoe retaining bars are positioned at enlarged areas 74 and 76. It should be understood and appreciated that the shoe rack could be constructed so that the vertical surface is to the left of the page, or to the right of the page.

Figure 6:
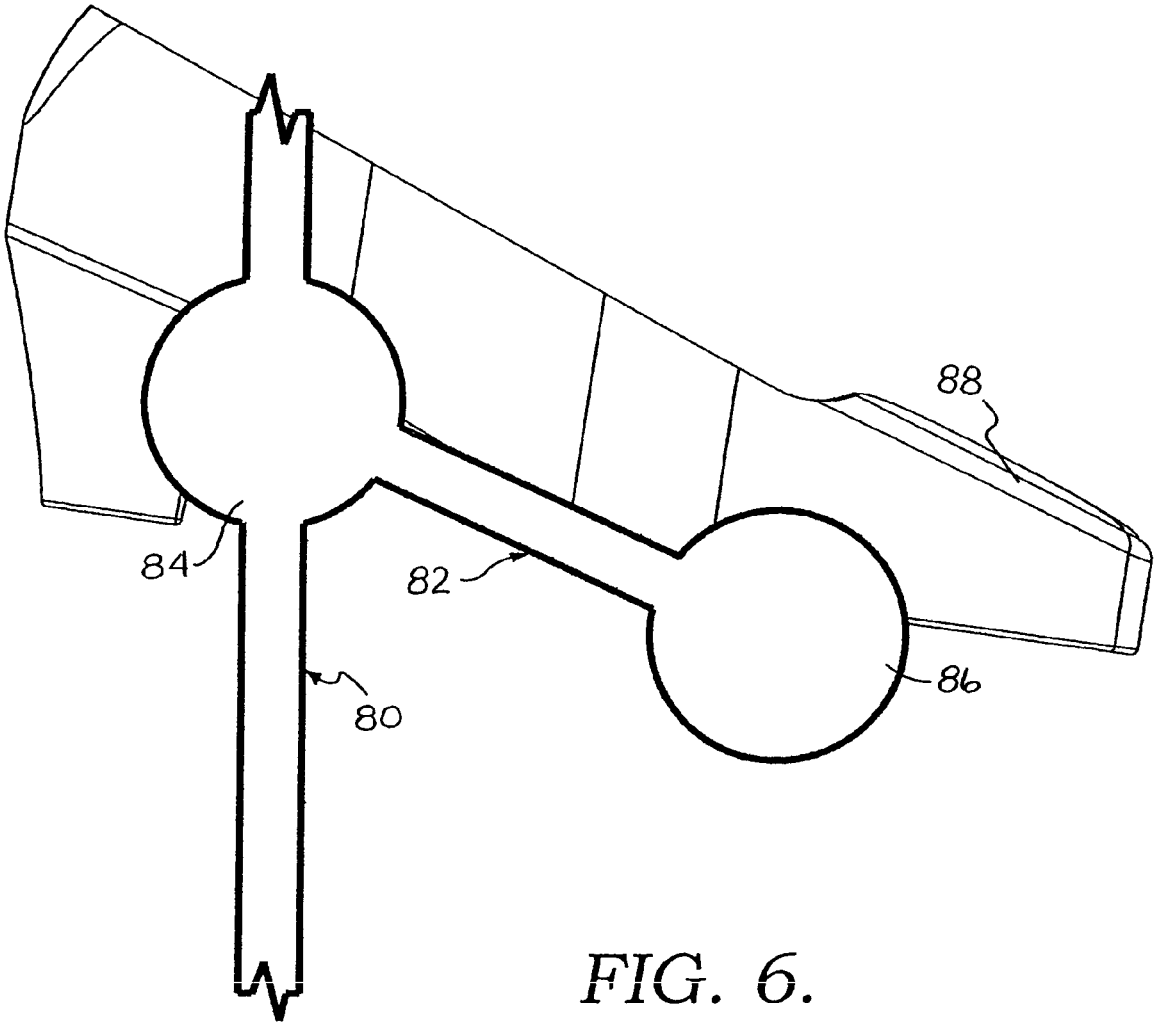
FIG. 6 is a fragmentary view illustrating a sixth embodiment of a hanging shoe rack of the present invention.

With reference now to FIG. 6, the hanging shoe rack in this embodiment of the invention has a vertical side frame member 80 and a plurality of downwardly and outwardly extending support arms 82. The molded construction of this embodiment provides enlarged portions 84, 86. Sockets for receiving shoe retaining bars are preferably positioned centrally on the opposite side of enlarged areas 84, 86. In this embodiment, the combination of vertical member 80 and the enlarged areas 84, 86 provide a barrier against lateral movement of the shoe 88 when positioned on the shoe rack.

Figure 7:
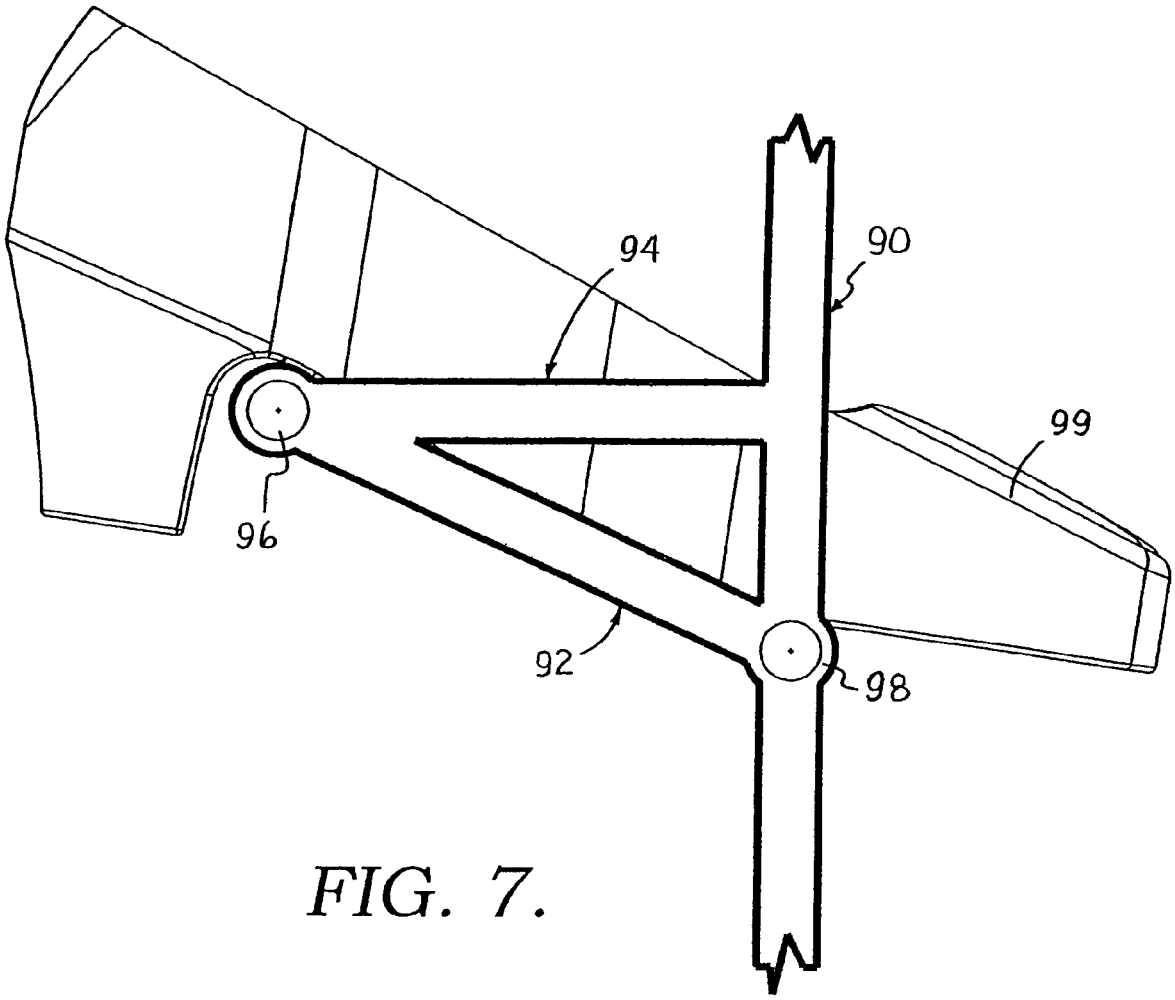
FIG. 7 is a fragmentary view illustrating a seventh embodiment of a hanging shoe rack of the present invention.

In the embodiment of FIG. 7, the shoe rack of the present invention includes a vertical member 90, a plurality of outwardly and upwardly angled support arms 92, and a horizontal barrier arm 94, positioned as shown. Shoe retaining bars are positioned in sockets at enlarged locations 96 and 98. The shoe 99 is retained on the bars primarily by the combination of vertical member 90 and barrier arm 94, and to a lesser degree by the angled support arms 92.

Figure 8:
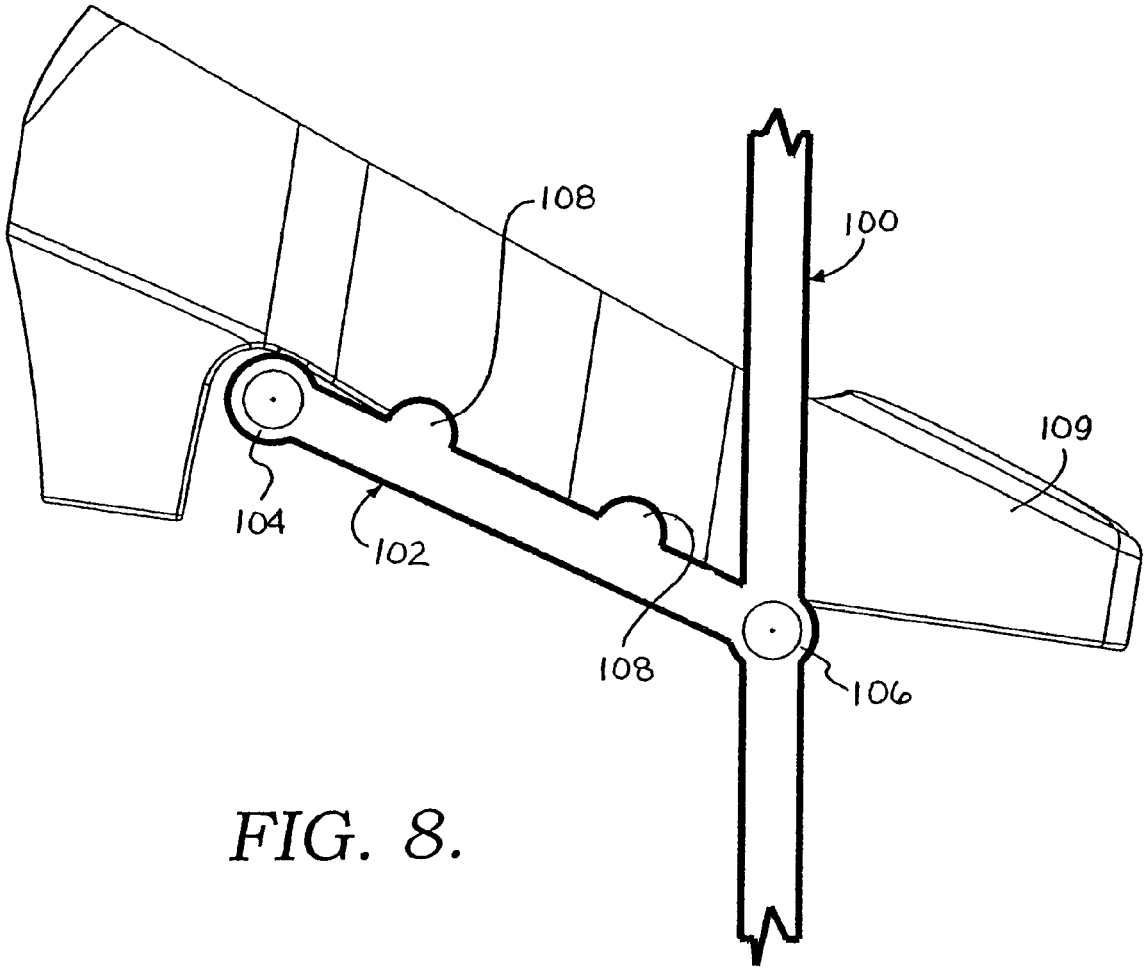
FIG. 8 is a fragmentary view illustrating an eighth embodiment of a hanging shoe rack of the present invention.

In the embodiment of FIG. 8, the hanging shoe rack of the present invention includes a vertical member 100, and a plurality of outwardly and upwardly angled support arms 102. Sockets for receiving shoe retaining bars are positioned at enlarged areas 104 and 106. A particular aspect of this embodiment is the provision of tabs 108 positioned at an upper portion of support arm 102. As illustrated, the combination of vertical member 100 and tabs 108 provide a barrier against lateral movement of shoe 109.

Figure 9:
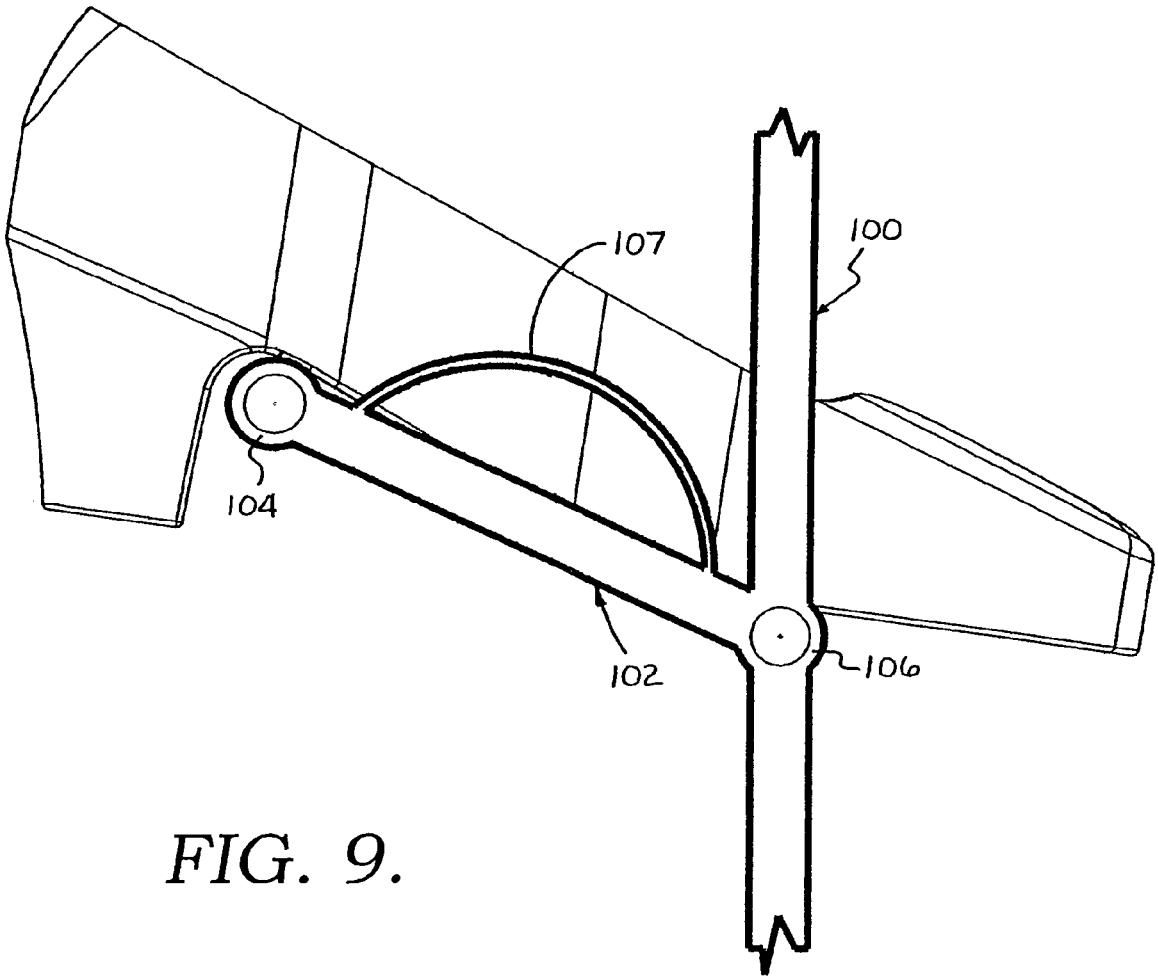
FIG. 9 is a fragmentary view illustrating a ninth embodiment of a hanging shoe rack of the present invention.

In an alternative embodiment of FIG. 8, FIG. 9 has a similar vertical member 100, an angled support arm 102, with socket areas 104, 106. However, instead of the tabs 108 previously described, a loop portion 107 is presented for providing an additional lateral barrier. While the loop portion 107 is preferably formed of molded plastic, it could also be formed of another suitable material, such as wire. In the case where the loop 107 is formed of wire, it is potted into the molding compound used for forming the support arm 102.

Figure 10:
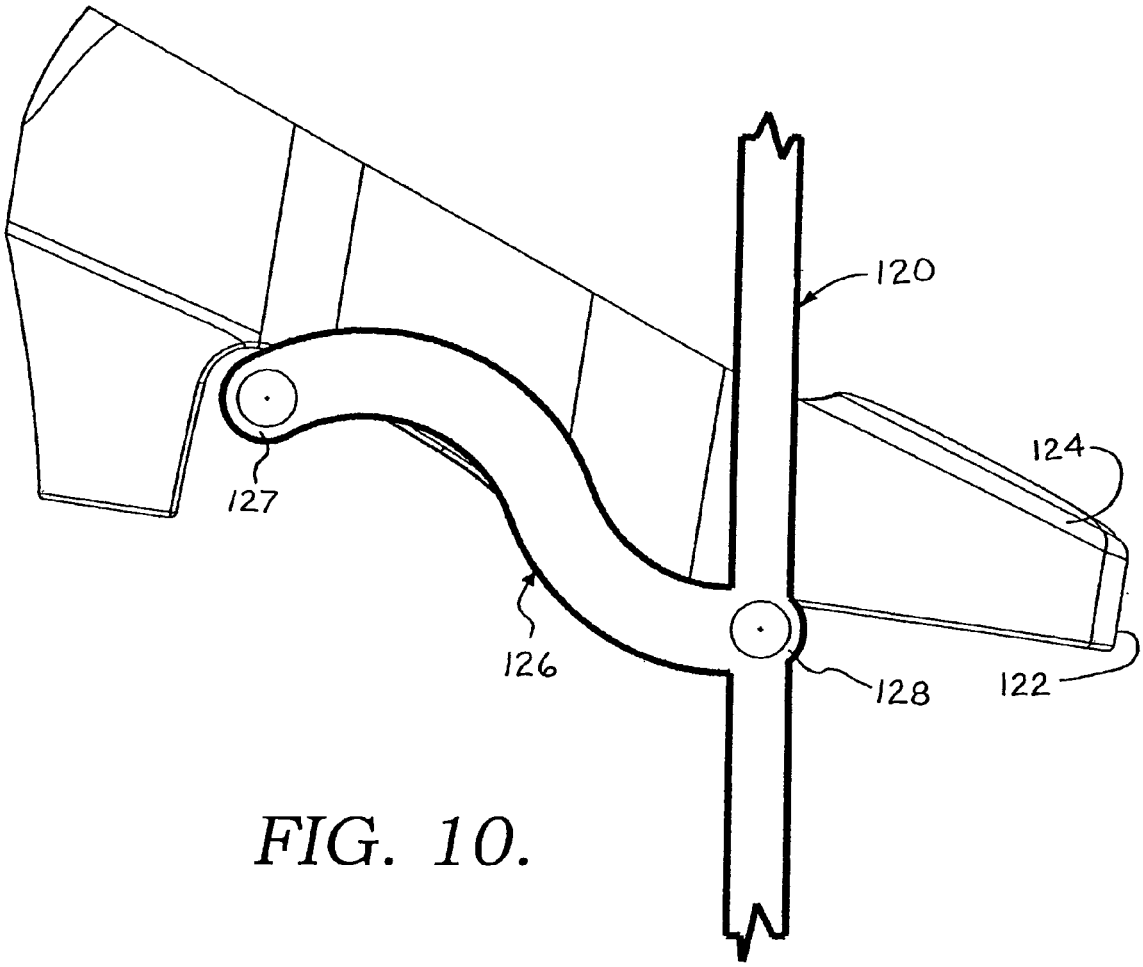
FIG. 10 is a fragmentary view illustrating a tenth embodiment of a hanging shoe rack of the present invention.
Figure 11:
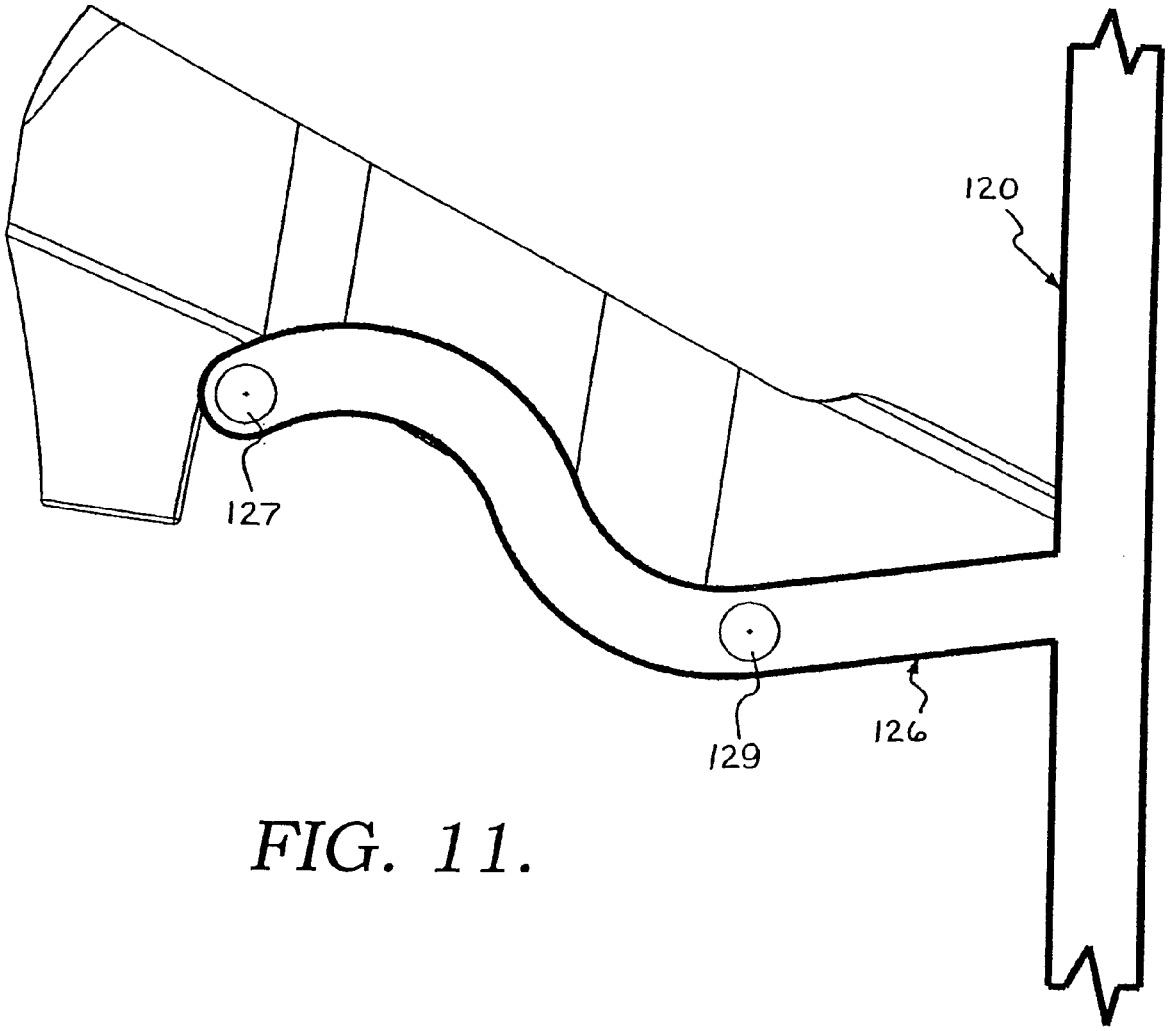
FIG. 11 is a fragmentary view illustrating an eleventh embodiment of a hanging shoe rack of the present invention.

In the embodiments of FIGS. 10 and 11, a vertical support member 120 is provided. In the embodiment of FIG. 10, vertical support member 120 is positioned outwardly from an upright surface upon which the shoe rack is mounted. In this regard, the shoe rack is preferably mounted such that the toe portion 122 of the shoe 124 abuts up against the upright surface. In contrast, in the embodiment of FIG. 11, the vertical portion 120 preferably abuts up against the upright surface.

In each embodiment, a support arm 126 is provided. In a particular aspect of these embodiments, support arm 126 is curved in an "S-curve". In the embodiment of FIG. 10, the socket areas 127, 128 are positioned as shown, with the socket 128 being in the vertical member 120. In contrast, in the embodiment of FIG. 11, each socket area 127, 129 is on the support arm 126.

As illustrated, the precise nature of the "S-curve" arm 126 is different in each embodiment, with different dimensions at different angles. It will be understood and appreciated that variations of this S-curve feature may be made without departing from the spirit and scope of the invention.

Figure 12:
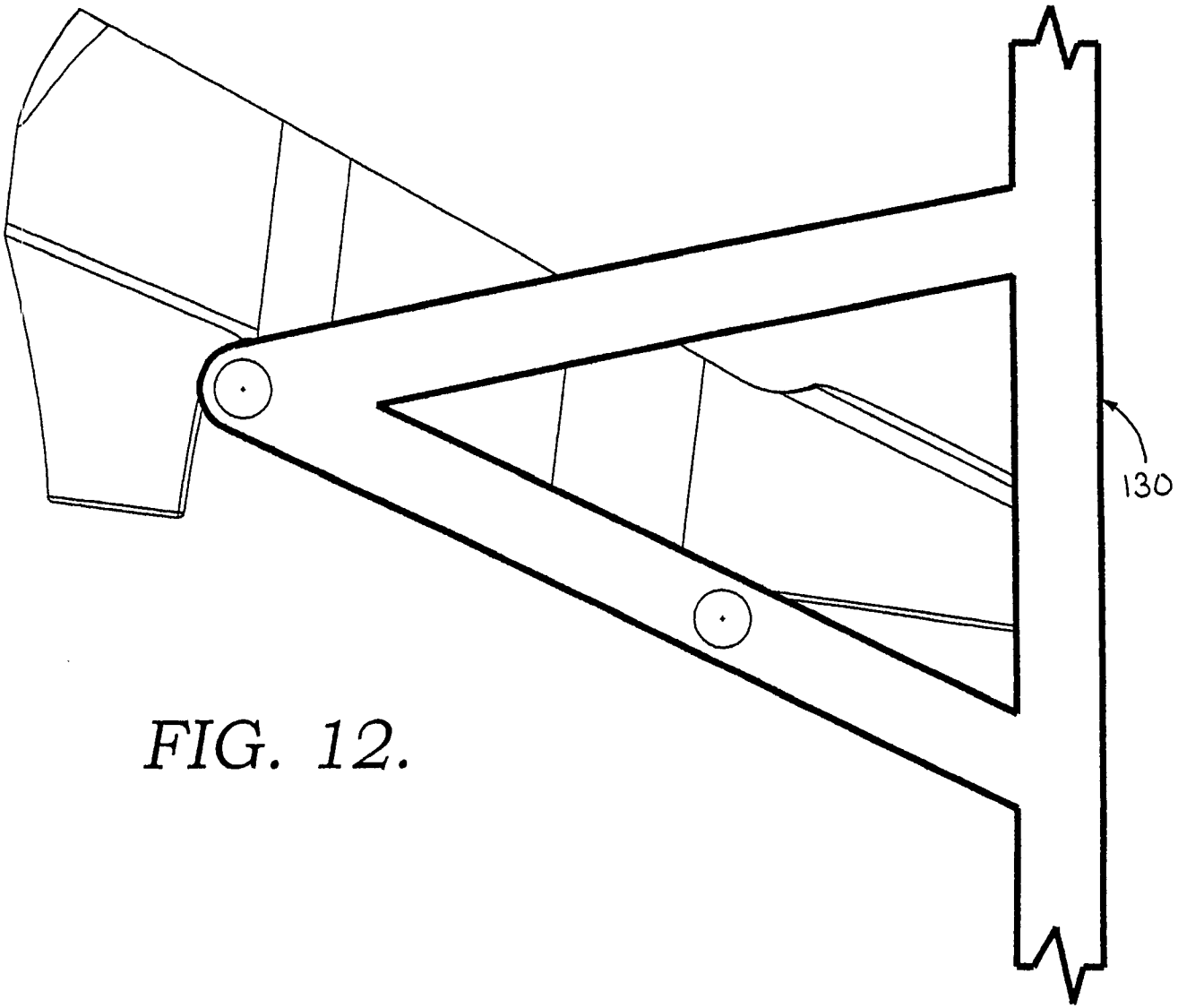
FIG. 12 is a fragmentary view illustrating a twelfth embodiment of a hanging shoe rack of the present invention.
Figure 13:
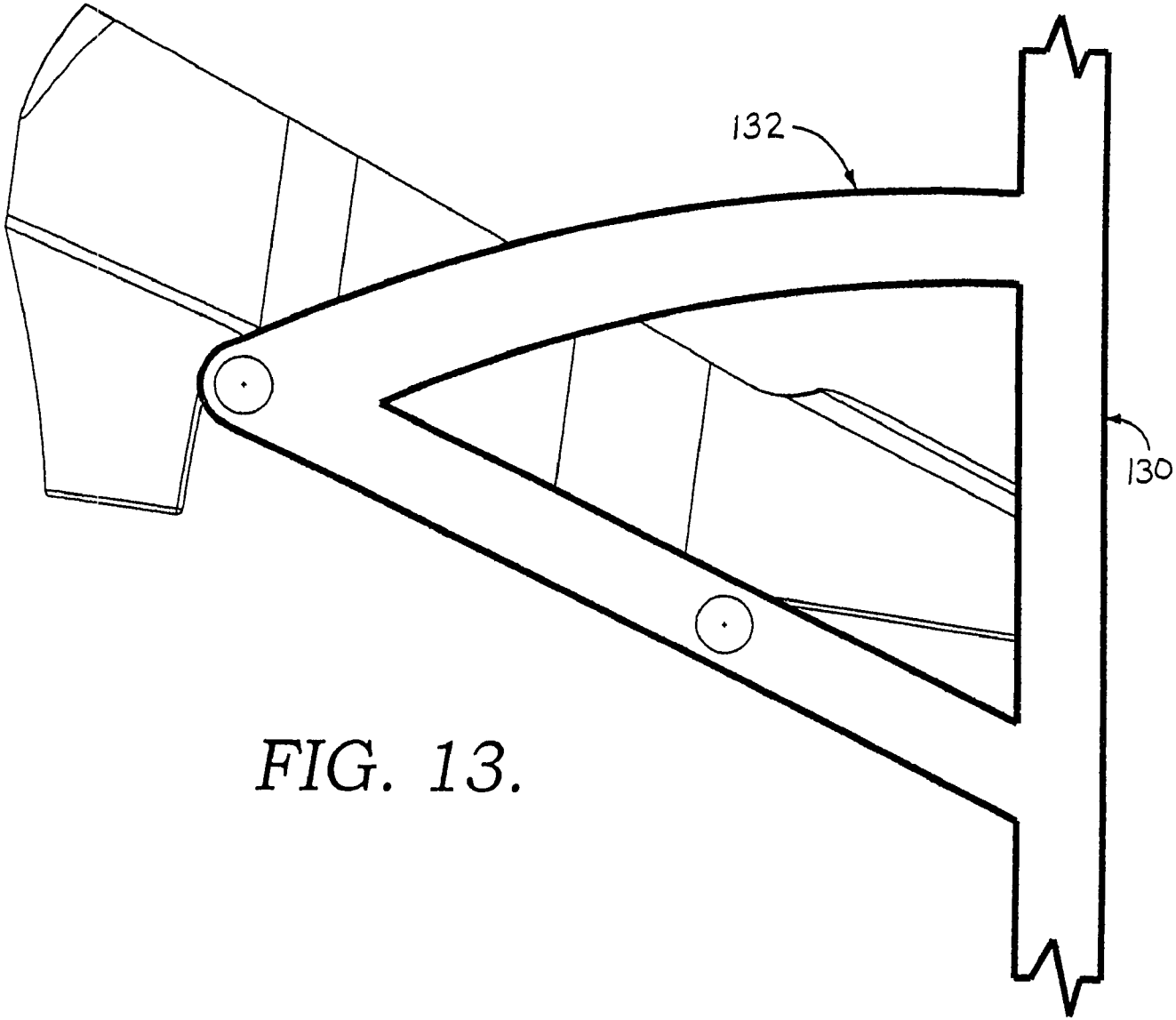
FIG. 13 is a fragmentary view illustrating a thirteenth embodiment of a hanging shoe rack of the present invention.

The embodiments of FIGS. 12 and 13 are similar to the embodiment of FIG. 7, with the exception that the vertical member 130 is positioned in abutment against the upright surface. Further, as illustrated in the alternative embodiment shown in FIG. 13, the barrier arm 132 may be curved or arcuate rather than horizontal as shown in FIGS. 7 and 12. As can be seen in both FIGS. 12 and 13, only the dimensions and appearance of the product have changed, but each serves the purpose of preventing lateral movement of the shoes.

Figure 14A:
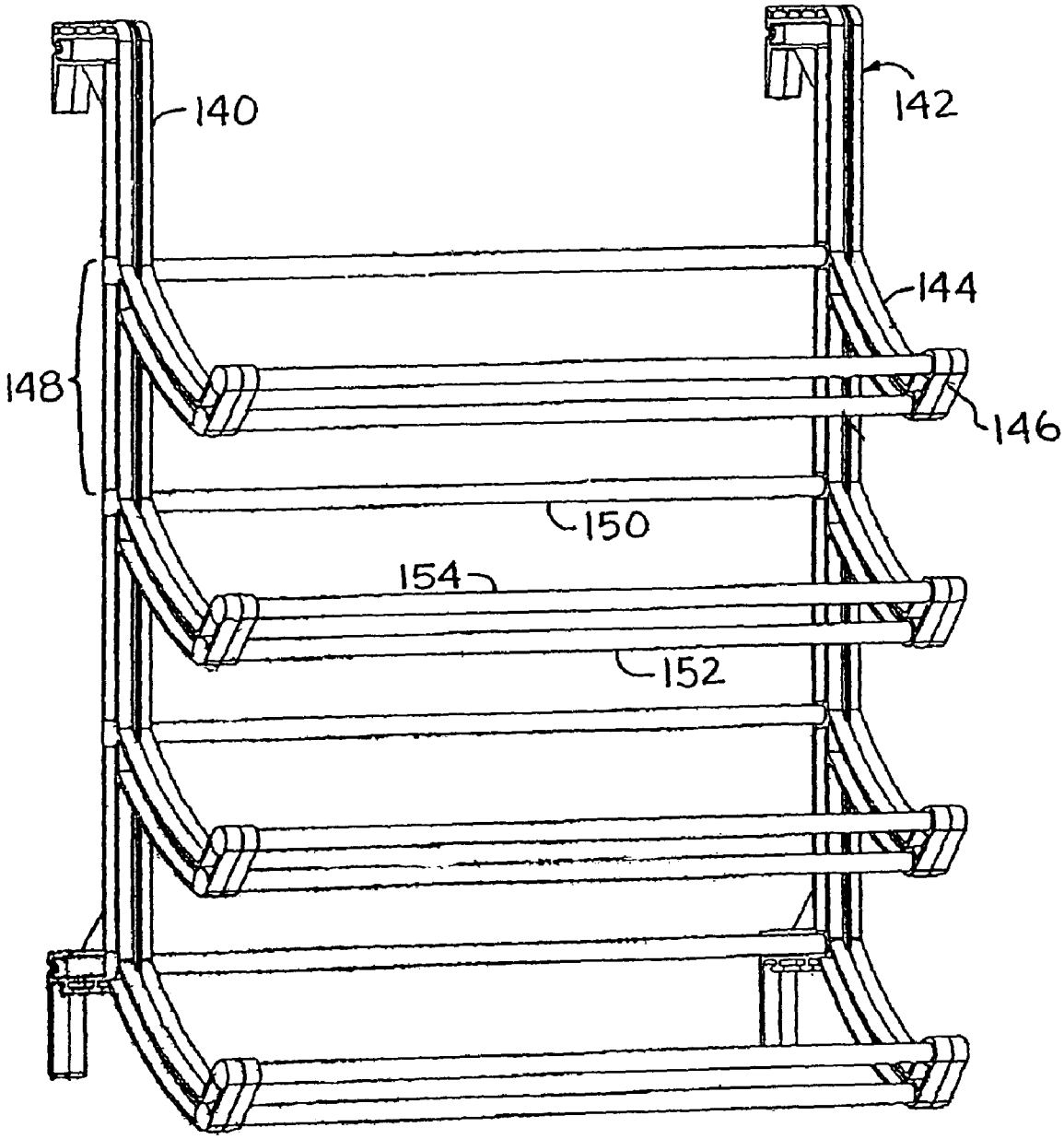
FIGS. 14*a* and 14*b* illustrate a fourteenth embodiment of a hanging shoe rack of the present invention.
Figure 14B:
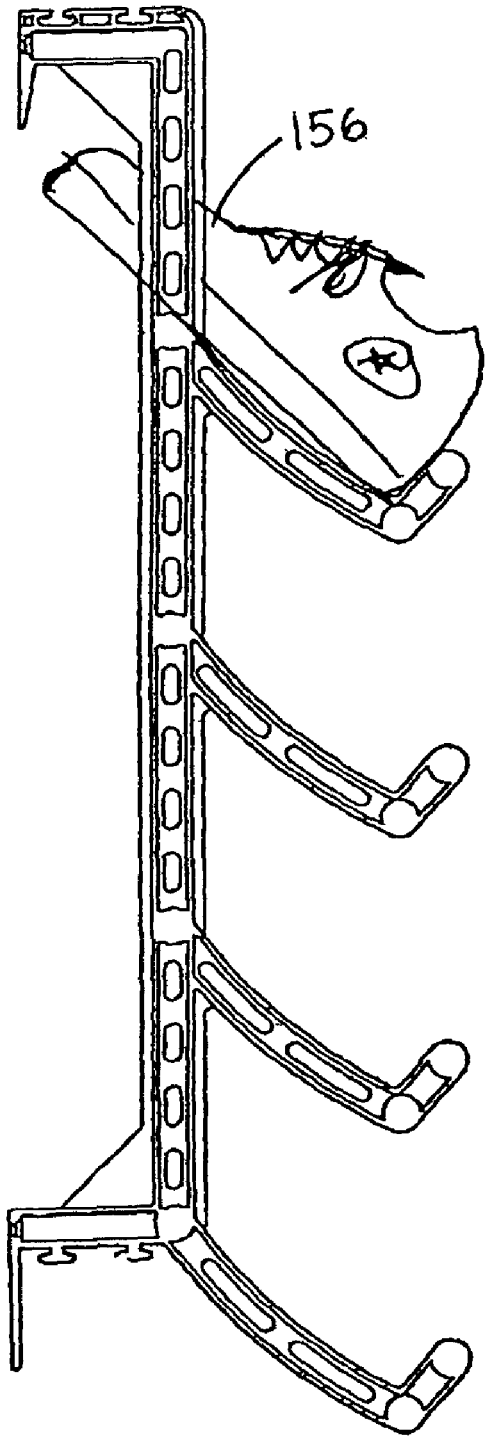

The embodiment of FIGS. 14*a* and 14*b* have first and second side frame members 140, 142, each having a number of support arms 144 angled outwardly and downwardly therefrom. Each support arm 144 has an angled portion 146 at an outer end thereof. As illustrated, the hanging shoe rack of this embodiment has a number of shoe retaining tiers 148. Each tier 148 has a first bar 150 a second bar 152 and a third bar 154, positioned as shown. In particular, bars 152, 154 form a parallel pair of bars for retaining shoes in a tilted manner as illustrated in FIG. 14*b*, such that the shoes are angled upwardly toward the surface upon which the shoe rack is mounted or positioned.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A shoe rack, for hanging on an upright surface, said shoe rack comprising:

first and second opposed side frame members, each said side frame member having a main body section and a plurality of support arms projecting outwardly therefrom, wherein each support arm has one end adjacent to said main body section and another free end displaced from said side frame member, and wherein each support arm has at least one loop extending upwardly therefrom at a location between said one end and said free end, each said loop having opposite ends connected with said support arm at offset locations to present an open space above each said support arm between said loop and said support arm;

a plurality of joints on said side frame members; and a plurality of shoe retaining bars extending between said joints of said side frame members for receiving and holding shoes, said loops being offset from said joints, wherein said loops provide a barrier against lateral movement of shoes positioned on said shoe retaining bars of said shoe rack.

* * * * *